United States Patent [19]

Küpper et al.

[11] Patent Number: 4,651,865

[45] Date of Patent: Mar. 24, 1987

[54] DEVICE FOR UNLOADING A COIL CONVEYOR

[75] Inventors: Wilhelm Küpper, Wegberg; Helmuth Hensen, Moenchengladbach, both of Fed. Rep. of Germany

[73] Assignee: W. Schlafhorst & Co., Moenchengladbach, Fed. Rep. of Germany

[21] Appl. No.: 805,328

[22] Filed: Dec. 4, 1985

[30] Foreign Application Priority Data

Dec. 11, 1984 [DE] Fed. Rep. of Germany ..... 3445040

[51] Int. Cl.[4] ..... B65G 47/90

[52] U.S. Cl. ..... 198/468.2; 198/406; 198/598; 242/35.5 A

[58] Field of Search ..... 198/406, 599, 416, 635, 198/598, 468.2, 468.6, 470.1, 477.1, 478.1, 482.1, 487.1, 803.9; 242/35.5 A, 35.5 T, 46

[56] References Cited

U.S. PATENT DOCUMENTS

| | | | |
|---|---|---|---|
| 1,510,096 | 9/1924 | Miller | 198/406 |
| 2,585,674 | 2/1952 | Owen | 198/406 |
| 3,907,124 | 9/1975 | Legg | 198/416 X |
| 4,036,353 | 7/1977 | Suter | 198/803.9 |
| 4,181,228 | 1/1980 | Hashimoto et al. | 242/35.5 A |
| 4,195,789 | 4/1980 | Mista | 242/35.5 A |
| 4,403,471 | 9/1983 | Oswald | 198/468.2 X |
| 4,506,780 | 3/1985 | Novak et al. | 198/487.1 X |
| 4,598,869 | 7/1986 | Uchida et al. | 242/35.5 A |

FOREIGN PATENT DOCUMENTS

| | | | |
|---|---|---|---|
| 0634019 | 8/1936 | Fed. Rep. of Germany | 242/35.5 A |
| 3428066 | 2/1985 | Fed. Rep. of Germany | 242/35.5 A |
| 3,407,572 | 9/1985 | Fed. Rep. of Germany | 242/35.5 A |
| 0374919 | 3/1964 | Switzerland | 242/35.5 A |

*Primary Examiner*—Joseph E. Valenza
*Assistant Examiner*—Lyle Kimms
*Attorney, Agent, or Firm*—Herbert L. Lerner; Laurence A. Greenberg

[57] ABSTRACT

Device for unloading textile coils from a coil conveyor provided with take-up mandrels, the textile coils having coil tubes by which the coils are stuck onto the take-up mandrels, includes at an unloading station of the coil conveyor, a fork pivotable about a pivot shaft in a plane perpendicular to the axis of a take-up mandrel thereat and a textile coil stuck thereon for gripping under the lower end of at least one of the coil and the coil tube and supporting the coil tube, the fork being connected to a counterbearing disposed above the textile coil and pivotable in the same rotational sense as the fork, a lifting device connected to the pivot shaft of the fork for lifting the textile coil, a deflector wall located adjacent the coil conveyor, the fork being pivotable with the lifted textile coil and, with upper parts of the textile coil disposed against the counterbearing, until the fork is beneath the deflector wall and the textile coil comes into contact with the deflector wall, the textile coil being slideable on the deflector wall out of the fork and along the deflector wall onto a coil receiving device disposed under the unloading station.

4 Claims, 7 Drawing Figures

DEVICE FOR UNLOADING A COIL CONVEYOR

The invention relates to a device for unloading a coil conveyor provided with take-up mandrels, the textile coils having coil tubes by which the coils are stuck onto the take-up mandrels.

When the coil conveyor is being unloaded, special consideration should be given not to damage the textile coils as they are removed from the take-up mandrels. Due to unloading devices which are not always trouble-free, damage to the coils and the coil tubes or cores thereof occur which, at first, remain unrecognized, and only later during winding or further processing of the threads lead to recognizable faults which are then difficult to remove or rectify and, under certain conditions, result in low quality or even scrapped goods.

It is accordingly an object of the invention to provide a device for unloading a coil conveyor having take-up mandrels for textile coils which accomplishes its purpose rapidly and with great care by relatively simple means.

With the foregoing and other objects in view, there is provided, in accordance with the invention, a device for unloading textile coils from a coil conveyor provided with take-up mandrels, the textile coils having coil tubes by which the coils are stuck onto the take-up mandrels, comprising at an unloading station of the coil conveyor, a fork pivotable about a pivot shaft in a plane perpendicular to the axis of a take-up mandrel thereat and a textile coil stuck thereon for gripping under the lower end of at least one of the coil and the coil tube, and supporting the coil tube, the fork being connected to a counterbearing disposed above the textile coil and pivotable in the same rotational sense as the fork, a lifting device connected to the pivot shaft of the fork for lifting the textile coil, a deflector wall located adjacent the coil conveyor, the fork being pivotable with the lifted textile coil and, with upper parts of the textile coil disposed against the counterbearing, until the fork is beneath the reflector wall and the textile coil comes into contact with the deflector wall, the textile coil being slidable on the deflector wall out of the fork and along the deflector wall onto a coil receiving device disposed under the unloading station.

In accordance with another feature of the invention, the counterbearing is mounted on a vertical post connected to the fork and is resiliently yieldable upwardly.

In accordance with a further feature of the invention, the counterbearing has a coil tube holder inwardly overlapping an upper edge of the coil tube.

In accordance with a concomitant feature of the invention, the coil receiving device is formed of a conveyor belt running parallel to a transporting direction of the coil conveyor, and the deflector wall is disposed in an inclined position above the conveyor belt and in a conveying direction of the conveyor belt.

Other features which are considered as characteristic for the invention are set forth in the appended claims.

Although the invention is illustrated and described herein as embodied in a device for unloading a coil conveyor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
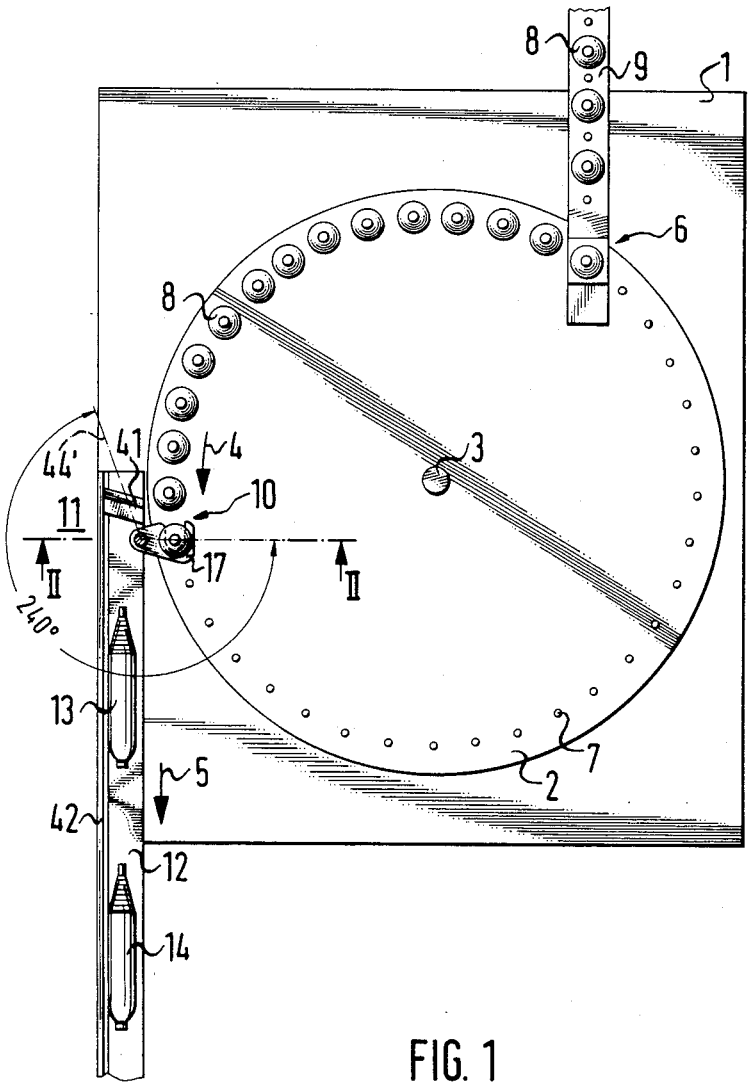
FIG. 1 is a top plan view of a conveyor system incorporating a device for unloading a coil conveyor constructed in accordance with the invention.

Referring now to the drawing and, first, particularly to FIG. 1 thereof, there is shown a coil conveyor 2 mounted on a table 1. The coil conveyor 2 is disc-shaped and is connected to a central shaft 3. The coil conveyor 2 can be turned stepwise in direction of the arrow 4. Take-up mandrels 7 are arranged in a circle on the coil conveyor 2 adjacent the periphery thereof, and are surmounted by or have stuck thereon textile coils 8 at a loading station 6 to which the coils 8 are fed on a conveyor belt 9.

An unloading device identified as a whole by reference numeral 11 is located at an unloading station 10. A coil receiving device in the form of a conveyor belt 12 running in the direction of the arrow 5 is located beneath the unloading station 10. Two textile coils 13 and 14 which have previously been unloaded are already on the conveyor belt 12. In the case at hand, the textile coils are spinning cops.

Figure 2:
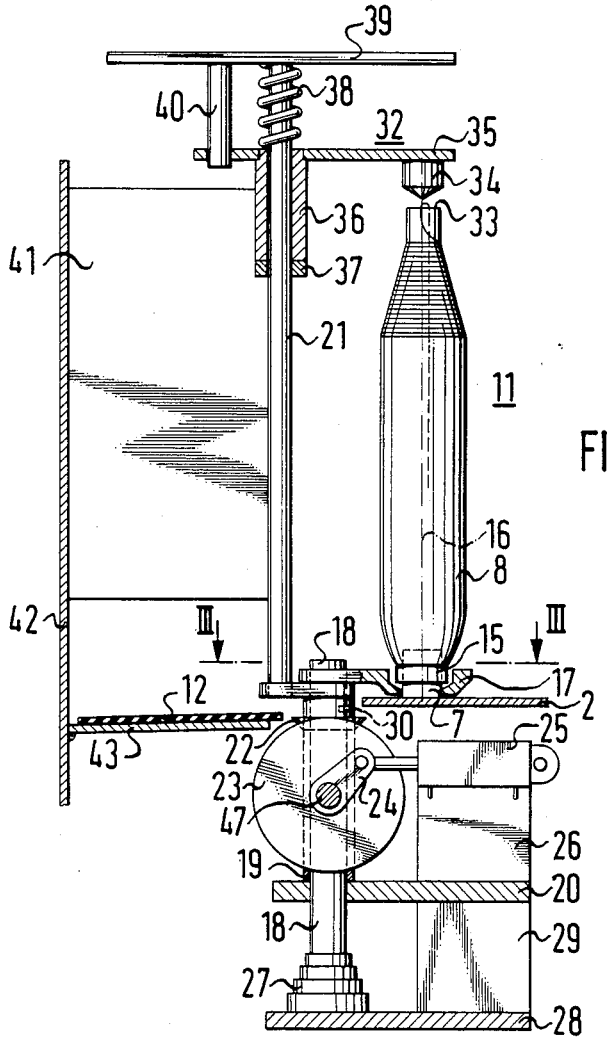
FIG. 2 is an enlarged fragmentary cross-sectional view of FIG. 1 taken along the line II—II in the direction of the arrows and showing the unloading device.

As shown especially in FIG. 2, the unloading device 11 has a prong or fork 17 which is pivotable in a plane perpendicular to the axis 16 of a coil or a take-up mandrel 7 and engages under and supports the lower end or foot of the next situated textile coil 8 and the coil tube or core 15 thereof. In accordance with FIG. 2, the fork 17 has a pivot shaft 18 which is freely rotatably mounted at the end of a telescopic tube arrangement 27. The telescopic tube arrangement 27 serves as a lifting device and is disposed on a plate 28 belonging to machine frame 29. The machine frame 29 carries another plate 20 in which the pivot shaft 18 receives lateral guidance. Above the plate 20, a sleeve 19 is placed on the pivot shaft 18 and carries a post or standard 21 and a conical or bevel gear 22. The gear 22 is united together with another conical or bevel gear 23 into a bevel gear transmission. A shaft 47 of the gear 23 is mounted on a post 48 (FIG. 7) and has a crank 24 which is articulatingly connected to a pneumatic servomotor 25. The pneumatic servomotor 25 is articulatingly mounted on a bracket or strap 26 connected to the plate 20.

Figure 4:
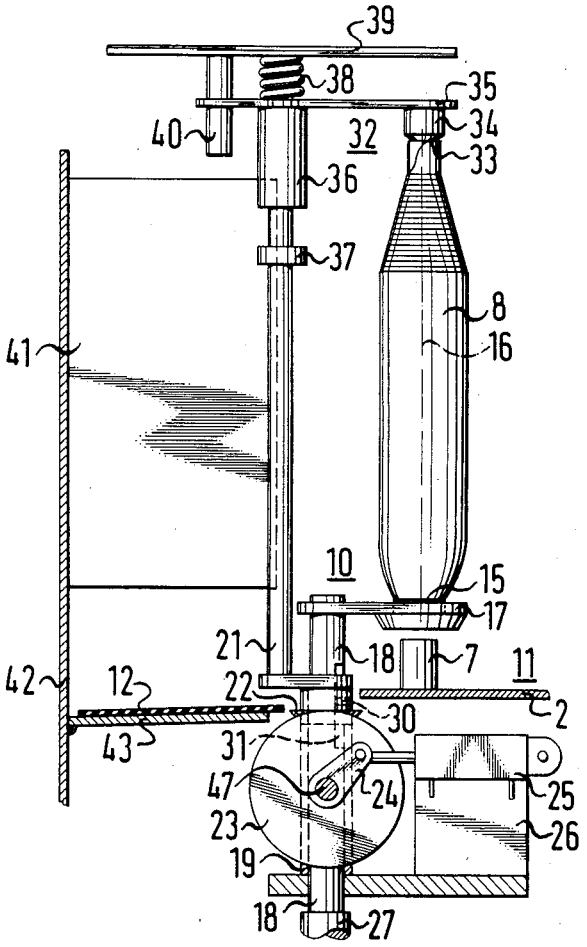
FIG. 4 is another view similar to that of FIG. 2 showing the unloading device with a textile coil lifted from the take-up mandrel.

The sleeve 19 has a radially inwardly directed entrainer 30 therein which engages in a slot 31 (FIG. 4) formed in the pivot shaft 18.

The fork 17 is connected via the entrainer 30, the sleeve 19 and the post 21 to a counterbearing 32 located above the textile coil 8 and pivotable in the same rotational sense as the fork 17. The counterbearing 32 has a coil tube or sleeve holder 34 inwardly overlapping the upper rim 33 of the coil tube or sleeve 15. The coil tube or sleeve holder 34 is seated at the end of a double-armed lever 35 which is fastened onto a tube 36. The tube 36 is longitudinally slidably stuck onto the post 21 and secured by a ring 37 connected to the post 21 against sliding down farther on the post 21. Above the tube 36, a spring 38 is wound on the post 21. At the top thereof, the spring 38 abuts a plate 39 connected to the upper end of the post 21. The plate 39 carries a downwardly projecting guide pin 40. The guide pin 40 engages in an opening formed in a rear part of the double-armed lever 35.

A baffle or deflector wall 41 is located at the unloading station 10 adjacent the coil conveyor 2. The baffle wall 41 is carried by a side wall 42 extending along and adjacent the conveyor belt 12. The side wall 42, according to FIG. 2, also carries a substantially horizontal wall 43 on which the upper course of the conveyor belt 12 lies. The baffle wall 41 is arranged above the conveyor belt 12 inclined in conveying direction as represented by the arrow 5 and, in fact, not entirely perpendicularly to the conveying direction 5, so that the textile coils sliding off the baffle or deflector wall 41 also slide as much as possible along the side wall and do not fall off the conveyor belt 12.

According to FIG. 1, the fork 17 with the lifted textile coil 8 is pivotable about an angle of substantially 240° to below the baffle or deflector wall 41.

Figure 3:
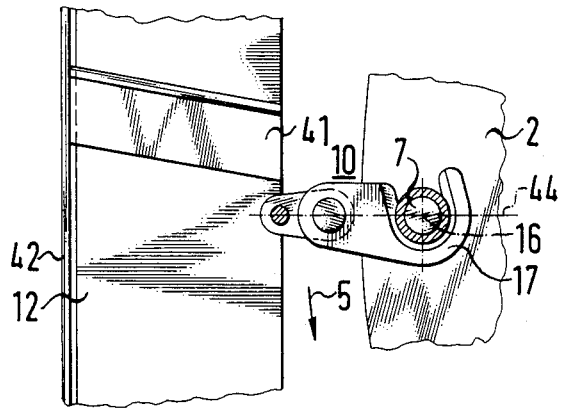
FIG. 3 is a sectional view of FIG. 2 taken along the line III—III in the direction of the arrows.

Controlled by an otherwise non-illustrated clock control device, the unloading device operates as follows:

The coil conveyor 2 travels on in synchronism, respectively, over the mean distance between two adjacent take-up mandrels 7. In between, it remains still until a textile coil 8 is stuck on at the loading station 6 and a textile coil has been unloaded at the unloading station 10. During the movement of the coil conveyor 2, the fork 17 is disposed in such manner that the longitudinal axis 44 thereof (FIG. 3) assumes the direction represented in phantom at 44' in FIG. 1, which means that the fork 17 has pivoted out of the range of the coil conveyor 2.

After actuating the pneumatic servomotor 25, the crank 24 assumes the position thereof shown in FIG. 2, and the fork 17 pivots under the coil sleeve or tube 15. Then, the telescopic tube arrangement 27 is subjected to compressed air, whereby the pivot shaft 18 is lifted out of the position thereof shown in FIG. 2 until it reaches the position thereof shown in FIG. 4. During the lifting operation, the coil core or tube holder 34 formed with a conical point grips the coil core or tube 15 behind the upper edge or margin 33 thereof. At the end of the upward movement of the pivot shaft 18, the lower end of the coil tube or core 15 is located above the take-up mandrel 7, the double-armed lever 35 has been raised by the textile coil 8, the tube 36 moved away from the ring 37 and the spring 38 has become compressed. Thus, the textile coil 8 has become resiliently clamped between the fork 17 and the counterbearing 32.

Figure 5:
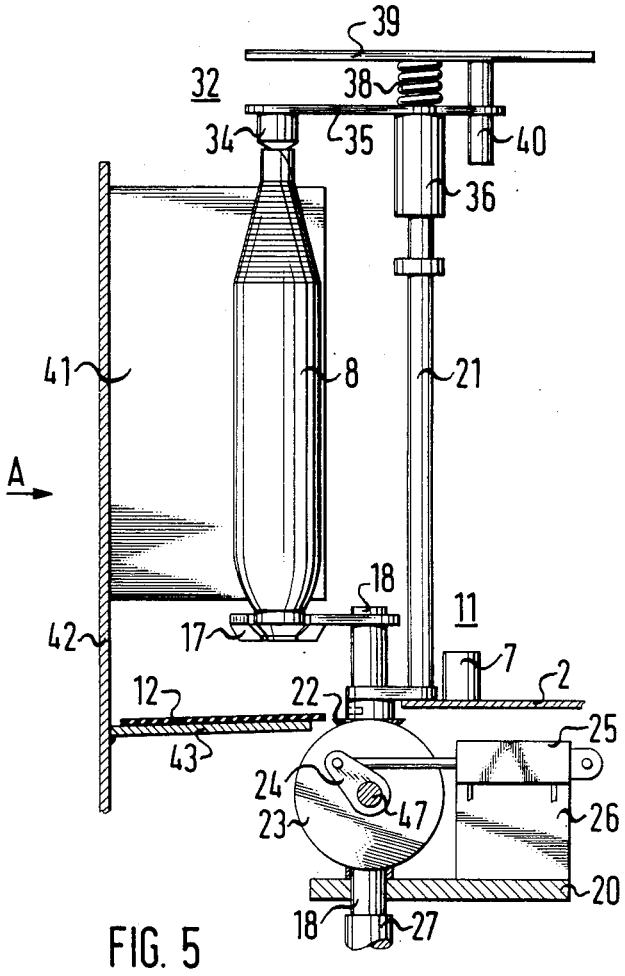
FIG. 5 is another view similar to those of FIGS. 2 and 4 showing the unloading device at the start of the coil delivery.

After the textile coil 8 has thus been lifted, the pneumatic servomotor 25 is activated to move the crank 24 out of the position thereof shown in FIG. 2 and into the position thereof shown in FIG. 5. This movement is imparted to the pivot shaft 18 via the bevel gear transmission 23,22 and the entrainer 30, so that the fork 17 is forced to perform its pivoting movement along a path covering an assumed 240°.

Figure 6:
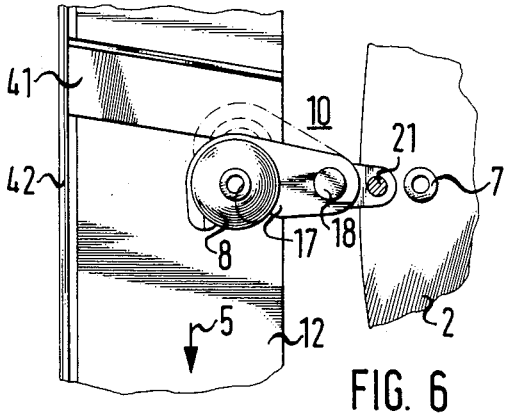
FIG. 6 is a fragmentary top plan view of FIG. 5 with the parts located above the coil removed.
Figure 7:
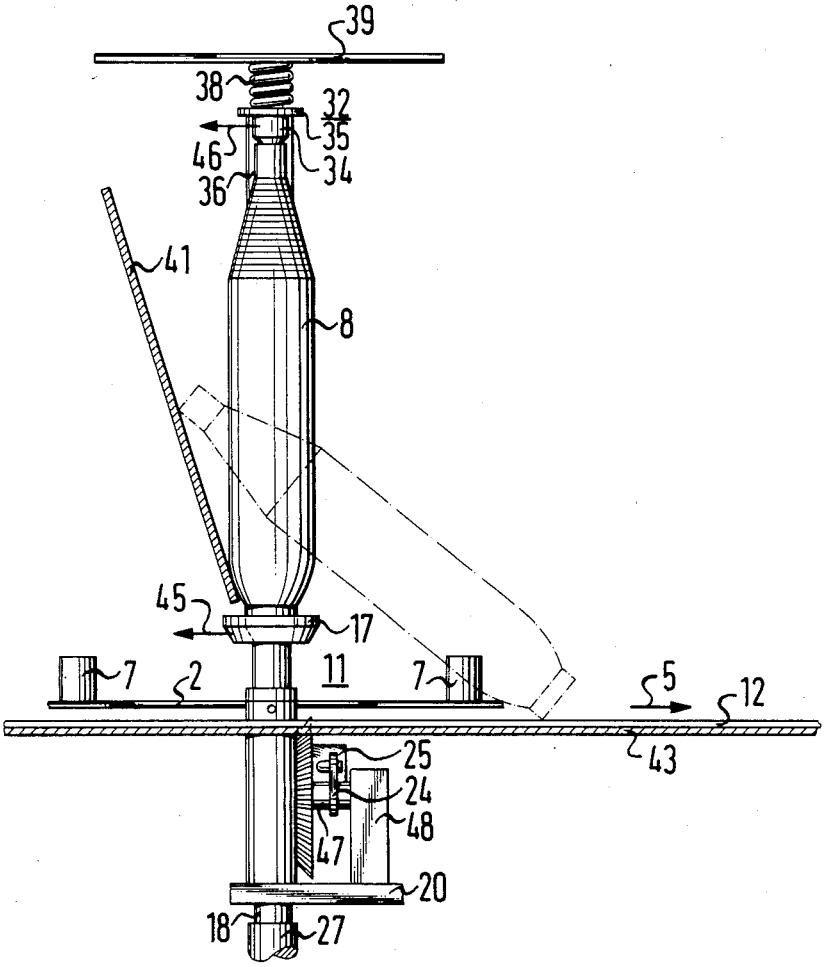
FIG. 7 is a view of FIG. 5 as seen in the direction of the arrow "a".

According to FIG. 6, the pivot path of the fork 17 has not quite ended yet. The fork 17 has just been swung back 180°. The lower part of the textile coil 8 has, in fact, come into contact with the baffle or deflector wall 41. This phase of operation is also represented in FIG. 7. The instant the fork 17 travels on in the direction of the arrow 45 and the coil tube holder 34 in the direction of the arrow 46, the lower end of of the textile coil 8 is held back by the baffle or deflector wall 41, while the upper end, however, remains entrained by the coil tube holder 34. The coil tube 15 slides out of the then lowering fork 17, whereby the textile coil, which has assumed an inclined position in the interim, loses its hold and experiences a backwardly directed guidance due to the then relaxed spring 38. The textile coil 8 slides in an inclined position onto the conveyor belt 12, as is shown in phantom in FIG. 7, and is transported on by the conveyor belt 12.

In the interim, a new textile coil has been stuck onto a respective take-up mandrel at the loading station 6 and a new operating cycle can begin.

As noted hereinbefore, the invention is not limited to the embodiment shown and described herein. The coil tube holder 34 can, for example, be constructed hood-like, alternatively. Instead of the telescopic tube arrangement 27, a toothed rack drive unit can be provided, for example, as the lifting device. The bevel gear transmission could be replaced by a lever joint arrangement or a spur gear arrangement. The baffle or deflector wall could alternatively be formed of individual elements such as rods, for example.

We claim:

1. Device for unloading textile coils from a coil conveyor provided with take-up mandrels, the textile coils having coil tubes by which the coils are stuck onto the take-up mandrels, comprising at an unloading station of the coil conveyor, a fork pivotable about a pivot shaft in a plane perpendicular to the axis of a take-up mandrel thereat and a textile coil stuck thereon for gripping under the lower end of at least one of the coil and the coil tube and supporting the coil tube, said fork being connected to a counterbearing disposed above the textile coil and pivotable in the same rotational sense as the fork, a lifting device connected to said pivot shaft of said fork for lifting the textile coil, a deflector wall located adjacent the coil conveyor, said fork being pivotable with the lifted textile coil and, with upper parts of the textile coil disposed against said counterbearing, until said fork is beneath said deflector wall and the textile coil comes into contact with said deflector wall, the textile coil being slidable on said deflector wall out of said fork and along said deflector wall onto a coil receiving device disposed under the unloading station.

2. Device according to claim 1, wherein said counterbearing is on a vertical post connected to said fork and is resiliently yieldable upwardly.

3. Device according to claim 1, wherein said counterbearing has a coil tube holder inwardly overlapping an upper edge of the coil tube.

4. Device according to claim 1, wherein said coil receiving device is formed of a conveyor belt running parallel to a transporting direction of the coil conveyor, and said deflector wall is disposed in an inclined position above said conveyor belt and in a conveying direction of said conveyor belt.

* * * * *